US012644629B2

(12) United States Patent
Cauchy et al.

(10) Patent No.: US 12,644,629 B2
(45) Date of Patent: Jun. 2, 2026

(54) GRAPHENE THERMAL CONDUCTIVITY USING HIGHLY CONDUCTIVE ISOTROPIC CLADDING

(71) Applicant: Promethient, Inc., Traverse City, MI (US)

(72) Inventors: Charles J. Cauchy, Traverse City, MI (US); William Myers, Traverse City, MI (US); Zachary Cauchy, Kingsley, MI (US)

(73) Assignee: Promethient, Inc., Traverse City, MI (US)

( * ) Notice: Subject to any disclaimer, the term of this patent is extended or adjusted under 35 U.S.C. 154(b) by 432 days.

(21) Appl. No.: 18/164,210

(22) Filed: Feb. 3, 2023

(65) Prior Publication Data

US 2023/0251001 A1 Aug. 10, 2023

Related U.S. Application Data

(60) Provisional application No. 63/306,662, filed on Feb. 4, 2022.

(51) Int. Cl.
*F25B 21/04* (2006.01)
*A47C 7/74* (2006.01)

(52) U.S. Cl.
CPC ..... *F25B 21/04* (2013.01); *A47C 7/746* (2013.01); *F25B 2321/025* (2013.01)

(58) Field of Classification Search
CPC ..... F25B 2321/025; F25B 2321/023; F25B 21/04
See application file for complete search history.

(56) References Cited

U.S. PATENT DOCUMENTS 7,205,510 B2 4/2007 Howick
8,937,106 B2 * 1/2015 Steinke ..... C08G 12/32 521/187

(Continued)

FOREIGN PATENT DOCUMENTS

DE 202011003384 U1 8/2011
DE 102019208691 A1 12/2020

(Continued)

OTHER PUBLICATIONS

Advanced Cooling Technologies; "HiK Plates with embedded heat pipes to in discrete locations for improved heat spreading"; https://www.1-act.com/products/hik-plates/; 6 pp.

(Continued)

*Primary Examiner* — Filip Zec
(74) *Attorney, Agent, or Firm* — Bodman PLC

(57) ABSTRACT

A heating and cooling device includes a thermoelectric module that is configured to move heat to or from a conductive surface thereof in response to low voltage power applied to the thermoelectric module. A composite structure is configured to conductively transfer heat between the thermoelectric module and the body. The composite structure includes a graphene sheet material that has an interfacing portion that is thermally coupled with and overlaying the conductive surface of the thermoelectric module. A high thermal conductivity isotropic cladding is disposed at least partially over an outlying portion of the graphene sheet material outside of the interfacing portion. The isotropic cladding conductively transfers heat in a direction orthogonal to a planar extent of the graphene sheet material with a higher thermal conductively than the graphene sheet material in this direction.

19 Claims, 4 Drawing Sheets

(56) References Cited

U.S. PATENT DOCUMENTS

| | | | | |
|---|---|---|---|---|
| 9,191,997 | B2 | 11/2015 | Wei | |
| 9,272,647 | B2 * | 3/2016 | Gawade | B60N 2/5692 |
| 9,534,098 | B2 * | 1/2017 | Peterson | C08J 9/0066 |
| 9,676,310 | B2 | 6/2017 | Fitzpatrick et al. | |
| 9,709,348 | B2 | 7/2017 | Cheng | |
| 9,755,130 | B2 * | 9/2017 | Kruiskamp | H10N 19/00 |
| 10,219,323 | B2 | 2/2019 | Inaba et al. | |
| 10,243,132 | B1 * | 3/2019 | Rosenblatt | H10N 69/00 |
| 10,351,029 | B2 | 7/2019 | Ziolek et al. | |
| 10,618,438 | B2 | 4/2020 | Tait et al. | |
| 10,632,879 | B2 | 4/2020 | Dacosta-Mallet et al. | |
| 10,998,485 | B1 * | 5/2021 | Przybysz | H10N 60/35 |
| 11,033,058 | B2 | 6/2021 | Cauchy | |
| 11,034,270 | B2 | 6/2021 | Schwintek et al. | |
| 11,173,816 | B2 | 11/2021 | Zhang et al. | |
| 11,186,061 | B2 | 11/2021 | Burwell et al. | |
| 11,600,760 | B2 * | 3/2023 | Hathaway | H10N 60/01 |
| 11,864,364 | B2 * | 1/2024 | Jung | H05K 7/20 |
| 12,196,389 | B2 * | 1/2025 | Jinno | F21S 41/285 |
| 12,292,215 | B2 * | 5/2025 | Strzalka | F25B 21/02 |
| 2004/0038049 | A1 * | 2/2004 | Suzuki | C25D 7/0614 428/458 |
| 2005/0121229 | A1 * | 6/2005 | Takai | B32B 27/36 174/250 |
| 2006/0137099 | A1 | 6/2006 | Feher | |
| 2007/0056957 | A1 | 3/2007 | Diemer et al. | |
| 2009/0255660 | A1 | 10/2009 | Cornie et al. | |
| 2011/0290775 | A1 | 12/2011 | Cubon et al. | |
| 2013/0087180 | A1 * | 4/2013 | Stark | H10N 10/13 136/205 |
| 2014/0097651 | A1 | 4/2014 | Fortune et al. | |
| 2014/0182063 | A1 * | 7/2014 | Crawford | C09K 5/14 252/75 |
| 2014/0183403 | A1 * | 7/2014 | Peterson | A47C 27/15 252/75 |
| 2016/0084542 | A1 * | 3/2016 | Kim | H10N 10/17 62/3.7 |
| 2016/0370133 | A1 * | 12/2016 | Liu | B32B 15/20 |
| 2017/0164757 | A1 | 6/2017 | Thomas et al. | |
| 2018/0272836 | A1 * | 9/2018 | Humer | B60N 2/5642 |
| 2019/0081229 | A1 * | 3/2019 | Aoyama | H10N 10/17 |
| 2019/0371992 | A1 * | 12/2019 | Tait | F25B 21/02 |
| 2020/0217565 | A1 * | 7/2020 | Boukai | F25B 21/02 |
| 2020/0248934 | A1 * | 8/2020 | Ghoshal | H10N 10/855 |
| 2021/0010723 | A1 * | 1/2021 | Nagy | F25B 47/006 |
| 2021/0041147 | A9 | 2/2021 | Cauchy | |
| 2021/0063060 | A1 * | 3/2021 | Young | H10N 60/82 |
| 2023/0130566 | A1 * | 4/2023 | Durfee | B60N 2/0034 297/180.12 |
| 2024/0108496 | A1 | 4/2024 | Gerrett et al. | |

FOREIGN PATENT DOCUMENTS

| | | | |
|---|---|---|---|
| EP | 2181015 | B1 | 5/2012 |
| EP | 3218942 | B1 | 2/2020 |
| WO | 2020174000 | A1 | 9/2020 |

OTHER PUBLICATIONS

AN-2020 "Thermal Design By Insight, Not Hindsight"; Texas Instruments Application Report, SNVA419C, Apr. 2010—Revised Apr. 2013; https://www.ti.com/lit/pdf/snva419; retrieved from the internet; 13 pp.

Li, et al. "Enhanced the thermal conductivity of flexible copper foil by introducing graphene"; Materials & Design, vol. 187, Feb. 2020; https://www.sciencedirect.com/science/article/pii/S0264127519308111; 10 pp.

* cited by examiner

GRAPHENE THERMAL CONDUCTIVITY USING HIGHLY CONDUCTIVE ISOTROPIC CLADDING

CROSS-REFERENCE TO RELATED APPLICATION

This application claims priority under 35 U.S.C § 119(e) to U.S. Provisional Patent Application No. 63/306,662, filed Feb. 4, 2022, the disclosure of this prior application is considered part of this application and is hereby incorporated by reference in its entirety.

TECHNICAL FIELD

The present disclosure relates to heating and cooling systems and devices and more specifically to thermally conductive structures used to conductively transfer heat to and from an object, such as flexible thermally conductive structures that directly or indirectly interface with a person's body.

BACKGROUND

The use of thermoelectric devices to heat and cool objects is well known, including the use of these solid state devices to heat and cool a person. The efficiency of the heat transfer, however, between a person and a thermoelectric device is often severely diminished by layers of insulating materials that are provided to comfortably contact the person's body.

In recent advancements, thin sheets and strips of graphene have been implemented for use with thermoelectric devices to utilize its high thermal conductivity to improve heat transfer between a person and the thermoelectric device, such as described in U.S. Pat. No. 11,033,058. However, in sheet form, the dense graphite has a platelet-like morphology with brittle characteristics and relatively weak Van der Waals bonds of the carbon to carbon layers. To strengthen the graphene sheets and strips, plastic films are commonly bonded to the graphene to enhance the graphene's bending and flexing. These plastic films, however, have very low thermal conductivity (e.g., 0.12-0.30 W/mK) and the undesirable effect of insulating the graphene sheets.

SUMMARY

The present disclosure provides a flexible composite structure and associated heating and cooling devices and systems for conductively heating or cooling, such as for implementations in garments, furniture, and seats of all types, including for various types of vehicles, child seat, industrial equipment, aviation, marine, railcars, power sports, motorcycles, and the like. The heating and cooling device or system may include a thermoelectric module that is configured to electrically generate heating or cooling. The flexible composite structure conductively transfers heat to and from the thermoelectric module, such as to provide heating or cooling to a person's body or portion thereof. The composite structure includes a graphene sheet material that is thermally coupled with the thermoelectric module and extends from the thermoelectric module, such as to a seat surface. To enhance the heat transfer of the composite structure, a highly thermally conductive isotropic cladding is disposed on the graphene sheet material at least partially outside of the portion directly interfacing with the thermoelectric module, such as near the thermoelectric module or near a seat surface. The highly conductive isotropic cladding conductively transfers heat in a direction generally aligned with the thickness of the graphene sheet material, such as in the Z direction when referencing the plane of the sheet in the X-Y plane or in a direction orthogonal to a planar extent of the graphene sheet material, with a higher thermal conductively than the graphene sheet material in this direction. The highly conductive isotropic cladding also has a higher thermal conductivity in the X-Y plane than other supportive layers, such as a plastic film or laminate that may be used in some examples as a substrate to support the graphene sheet material. The isotropic cladding may also improve the robustness and strength of the flexibility of the graphene sheet material, so as to optionally omit polymer film, at least partially, on the graphene sheet.

Due to the highly conductive isotropic structure, heat is moved in the Z direction more readily than the graphene sheet material. When comparing the highly conductive isotropic cladding, such as aluminum, and the graphene sheet material in isolation of each other, the isotropic cladding material is far more conductive in the Z direction. Accordingly, with the highly conductive isotropic cladding overlaying the graphene sheet material, the combination of the two materials have a lower overall thermal conductivity than the graphene sheet material alone. However, when heat enters the composite structure conductively through the highly conductive isotropic cladding, it conductively moves heat very well in the X, Y, and Z direction. In contrast, when a heat source (e.g., a thermoelectric device or human body) is in contact with the X-Y plane of the graphene material, the heat movement is impeded due to the poor Z direction thermal conductivity of the graphene material. In the highly conductive isotropic cladding, the heat moves well into the Z direction and also, allows the heat to move well in the X-Y plane. In that the highly conductive isotropic cladding covers an area on the graphene sheet material that is greater than the smaller heat input point, the heat is spread over a much larger area, providing a much greater thermal contact area that allows a greater quantity of heat to transfer into the graphene sheet material for transport in the X-Y plane.

According to one aspect of the disclosure, a heating and cooling device is provided for conductively heating or cooling a body. The heating and cooling device includes a thermoelectric module that is configured to move heat to or from a conductive surface thereof in response to low voltage power applied to the thermoelectric module. A composite structure is configured to conductively transfer heat between the thermoelectric module and the body. The composite structure includes a graphene sheet material that has an interfacing portion that is thermally coupled with and overlaying the conductive surface of the thermoelectric module. A highly thermally conductive isotropic cladding is disposed at least partially over an outlying portion of the graphene sheet material outside of the interfacing portion. The isotropic cladding conductively transfers heat in a direction orthogonal to a planar extent of the graphene sheet material with a higher thermal conductively than the graphene sheet material in this direction.

Implementations of the disclosure may include one or more of the following optional features. In some examples, the high thermal conductivity isotropic cladding is or includes a metal foil, such as an aluminum alloy. The graphene sheet material and the isotropic cladding, in some implementations, are both flexible. For instance, the graphene sheet material and the isotropic cladding may each have a Young's modulus of less than 100 GPa.

Also, in some implementations, the thermal conductivity of the graphene sheet material along its planar extent is from 375 W/mK to 5000 W/mK. The thermal conductivity of the graphene sheet material in the direction orthogonal to the planar extent of the graphene sheet material is, in some examples, less than 100 W/mK. In comparison, in some examples, the thermal conductivity of the isotropic cladding is greater than 200 W/mK.

Further, in some examples, the isotropic cladding is disposed between the conductive surface of the thermoelectric module and the interfacing portion of the graphene sheet material. For instance, the isotropic cladding may be disposed at an inner surface of the graphene sheet material facing the thermoelectric module and in some instances in thermal communication with the thermoelectric module or a surface that is in thermal communication with the thermoelectric module. In some implementations, the isotropic cladding is disposed at an outer surface of the graphene sheet material opposite the side facing the thermoelectric module.

According to another aspect of the disclosure, a thermally conductive composite structure is configured to conductively transfer heat between a thermoelectric module and a body. The thermally conductive composite structure includes a flexible thermally conductive sheet that includes a graphene material disposed in a planar extent of the flexible thermally conductive sheet. The thermal conductivity of the graphene material along the planar extent is from 375 W/mK to 5000 W/mK and orthogonal to the planar extent is less than 100 W/mK. An isotropic cladding is disposed at least partially over a portion of the flexible thermally conductive sheet that is configured to at partially interface with the thermoelectric module or the body, where thermal conductivity of the isotropic cladding is greater than 200 W/mK.

According to a further aspect of the disclosure, a heating and cooling device is for conductively heating or cooling a body. The heating and cooling device includes a thermoelectric module that is configured to move heat to or from a thermally conductive surface thereof in response to low voltage power applied to the thermoelectric module. A flexible composite structure is provided that is configured to conductively transfer heat between the thermoelectric module and a body. The flexible composite structure includes a graphene sheet material that has a first portion thermally coupled with and overlaying the thermally conductive surface of the thermoelectric module. The flexible composite structure also includes a high thermally conductive isotropic cladding disposed over the first portion of the graphene sheet material and at least partially over a second portion of the graphene sheet material outside of the first portion. The isotropic cladding is configured to conductively transfer heat between the thermoelectric module and the first and second portions of the graphene sheet material in a direction orthogonal to a planar extent of the graphene sheet material. The isotropic cladding has a higher thermal conductively than the graphene sheet material in the direction orthogonal to the planar extent of the graphene sheet material. Also, in some examples, a second piece of isotropic cladding is disposed at an outer surface of the graphene sheet material opposite inner surface.

According to a yet another aspect of the disclosure, a heating and cooling device is provided for conductively heating or cooling a body. The heating and cooling device includes a thermoelectric module that is configured to move heat to or from a conductive surface thereof in response to low voltage power applied to the thermoelectric module. The heating and cooling device also includes a composite structure that is configured to conductively transfer heat between the thermoelectric module and the body. The composite structure includes a graphene sheet material that has an interfacing portion thermally coupled with and overlaying the conductive surface of the thermoelectric module. The composite structure also includes an isotropic cladding that is disposed over an outer surface of the graphene sheet material at a distal portion that is outside of the interfacing portion. The isotropic cladding is configured to conductively transfer heat between the body and the graphene sheet material in a direction parallel to a thickness of the graphene sheet material. In some implementations, the isotropic cladding has a higher thermal conductivity than the graphene sheet material in the direction parallel to the thickness of the graphene sheet material. The thickness of the graphene sheet material is generally consistent over a planar extent of the graphene sheet material.

According to a yet a further aspect of the disclosure, a seating system is provided that includes a seat cushion and a seat back coupled with the seat cushion. The seating system includes a thermoelectric module that is configured to move heat to or from a conductive surface thereof in response to low voltage power applied to the thermoelectric module. A composite structure is configured to conductively transfer heat between the thermoelectric module and a body supported at the seat cushion and against the seat back. The composite structure includes a graphene sheet material that has an interfacing portion thermally coupled with and overlaying the conductive surface of the thermoelectric module. The graphene sheet material also includes a first distal portion disposed at the seat cushion and a second distal portion disposed at the seat back. A first high thermal conductivity isotropic cladding is disposed over an outer surface of the graphene sheet material at the first distal portion that is outside of the interfacing portion. A second isotropic cladding is disposed over an outer surface of the graphene sheet material at the second distal portion that is outside of the interfacing portion. The first and second isotropic claddings are configured to conductively transfer heat between the body and the graphene sheet material in a direction parallel to a thickness of the graphene sheet material.

The details of one or more implementations of the disclosure are set forth in the accompanying drawings and the description below. Other aspects, advantages, purposes, and features will be apparent upon review of the following specification in conjunction with the drawings.

BRIEF DESCRIPTION OF THE DRAWINGS

Like reference numerals indicate like parts throughout the drawings.

DETAILED DESCRIPTION

Figure 1:
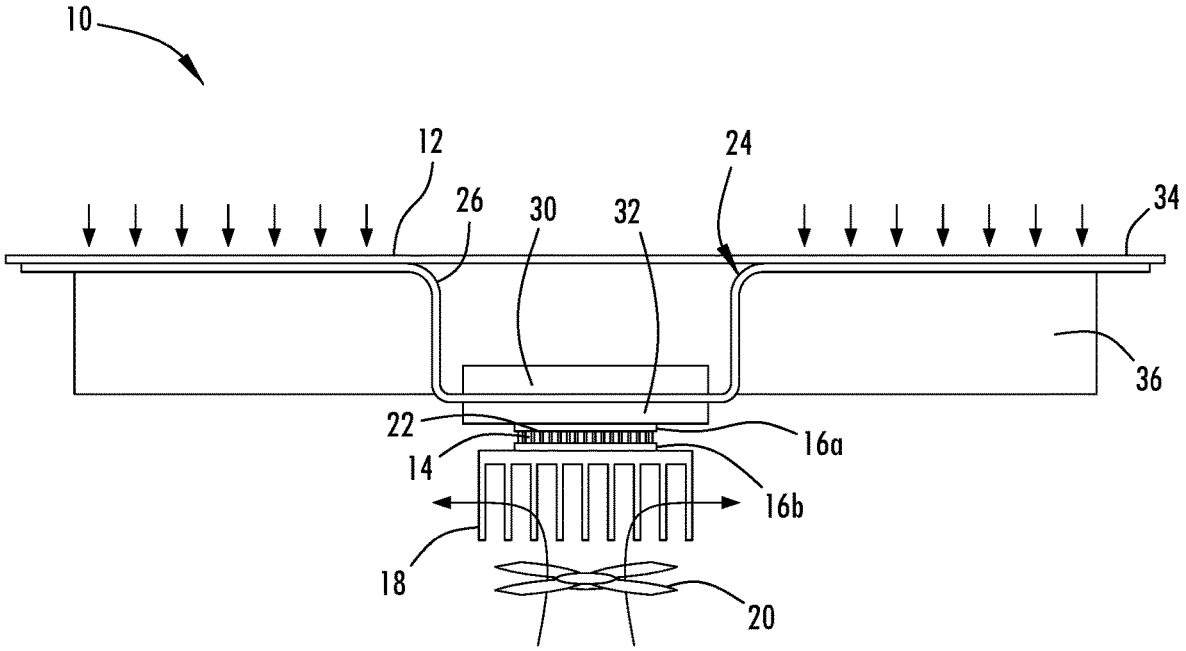
FIG. 1 is a side elevation view of a heating and cooling device in a seat, showing directional heat transfer.

Referring now to the drawings and the illustrative examples depicted therein, a heating or cooling device 10 (FIG. 1) is incorporated into a seating system and has a heating and cooling source that provides or otherwise transfers thermal energy in the system to conductively heat or cool the seat occupant in contact with the seat surface 12. In additional examples, the heating or cooling device may be incorporated in other conductive heating and cooling applications, such as in garments, furniture, and seats of all types, including for various types of vehicles, child seat, industrial equipment, aviation, marine, railcars, power sports, motorcycles, and the like. Moreover, in addition to conductively heating or cooling the body of a person, the heating or cooling device may be configured to conductively heat or cool other objects, such as electronics, food, beverages, medicines, animals, or the like. Accordingly, as used herein, the term "body" means a living person, animal, plant, or inanimate object, such as a device, a container, or the like.

The illustrated heating and cooling source is a thermoelectric module 14 that is a solid state device also commonly referred to as a thermoelectric device, thermoelectric heat pump, or Peltier cell. The thermoelectric module 14 is configured to move heat to or from a conductive surface thereof in response to low voltage power applied to the thermoelectric module 14. The thermoelectric module 14 includes an array of p-type and n-type semiconductor elements disposed electrically in series and thermally in parallel between two plates 16*a*, 16*b*, such as ceramic plates. The semiconductors are comprised of bismuth telluride, although in other examples they may be made of different types of materials. When low voltage power in the form of direct current passes through the p-type to the n-type semiconductor, a temperature drop is experienced at the junction according to the Peltier Effect and produces a cold side at one of the plates and a hot side at the other plate. For example, the thermoelectric device may be configured to operate efficiently from 10 to 16 V DC, so as to be compatible with common vehicle electrical system and other low-voltage applications. The power may be provided by one or many different sources, such as batteries, automotive and marine DC systems, AC/DC converters, and linear and switched DC power supplies. Further, by reversing polarity of the power input to the thermoelectric module 14, the Peltier Effect also reverses so that the hot side plate would become the cold side plate and the cold side plate would become the hot side plate.

As shown in FIG. 1, the thermoelectric module 14 is operating with electrical current providing the upper plate 16*a* as the cold side and the lower plate 16*b* as the hot side. To disperse the heat transferred to the hot side, the lower plate 16*b* includes a heat sink 18 that disperses the heat to the environment, such as by dispersing the heat over the surface area of the fins of the heat sink 18. The heat on the heat sink 18 may be quickly dissipated into the surrounding environment by the movement air over the fins of heat sink 18, such as with a fan 20 as shown in FIG. 1. It is contemplated that additional examples may include alternative means for dispersing heat or cold from the lower plate or side of the thermoelectric module directed that is directed away from the occupant or object being heated or cooled.

As further shown in FIG. 1, the conductive surface 22 on the upper plate 16*a* of the thermoelectric module 14 is operating to absorb heat and provide a cooling temperature effect. The conductive surface 22 may be thermally coupled with a thermally conductive structure that conductively transfers the heated or cooled temperature effect provided by the thermoelectric module 14 to the seat occupant and spreads or disperses the heated or cooled temperature effect over a surface area that directly or indirectly interfaces with the seat occupant, thereby distributing the cooling effect to a larger area than the conductive surface of the thermoelectric module itself. The thermally conductive structure shown in FIG. 1 is a composite structure 24 that is thermally coupled with the thermoelectric module 14 and extends from the thermoelectric module 14 toward the seat surface 12.

The composite structure 24 may include carbon based materials, such as graphite, to effectively spread the temperature difference out over a wider distribution area across the surface of the seat. The composite structure 24, for example as shown in FIG. 1, may include a graphene sheet material 26. Graphene, pyrolytic graphite, and highly oriented dense graphite are proven to be highly thermally conductive materials. Thermal conductivity can generally range from 500 to 2,000 W/mk or more in the X-Y plane of the sheet material. In comparison, high thermal conductivity metals have thermal conductivities that fall below this range. A single layer of graphene is defined as an atom-thick layer of graphite and generally has a high thermally conductivity in the range of approximately 2,000 to 4,000 W/mK, along the plane of the sheet or layer or otherwise referred to as in the X-Y plane or orthogonal to the thickness of the graphene sheet material.

The graphene sheet material 26 may include multiple layers of graphene, often in the form of platelets, nanoplatelets, nanotubes, and/or nanoparticles. Graphene can be formed into thin sheets or strips, which are somewhat flexible, depending on thickness. Having both highly conductive and flexible properties, allows the material to be used to conduct heat from a heat source in applications where bending and flexing are desirable. For example, the graphene sheet material may include one or more graphene nano-platelet sheets that are 5 micrometers to 500 micrometers thick. Such different morphology, layering, and structuring of the graphene sheet material may reduce or alter the thermal conductivity, such as to provide a thermal conductivity of the graphene sheet material 26 along its planar extent in a range of generally between 375 and 5,000 W/mK, or in some examples between 650 and 1550 W/mK, or in some examples between 400 and 4,000 W/mK, or in some examples between 400 and 500 W/mK, or in some examples greater than 300 W/mK, or in some examples greater than 800 W/mK.

Figure 2:
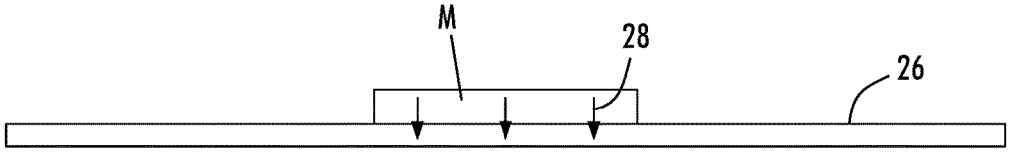
FIG. 2 is a side elevation view of a graphene sheet interfacing with a source of thermal energy, showing directional heat transfer.

Despite the high thermal conductivity in the X-Y plane, the thermal conductivity of the graphene sheet material 26 in the Z direction or direction orthogonal to the planar extent of the graphene sheet material is generally less than 100 W/mK, and in some examples between 4.5 and 20 W/mK. As such, the graphene sheet material 26 is highly anisotropic. For example, as shown in FIG. 2, the graphene sheet material 26 is transferring thermal energy, such as radiating or absorbing heat, with a mass M that may represent a thermoelectric module or a desired object, such as a seat occupant. In the example shown in FIG. 2, the heat transfer with the graphene sheet material 26 is in the Z direction 28 and the thermal conduction is limited to the surface area between the mass M and the outer surface of the graphene sheet material.

Referring again to FIG. 1, the graphene sheet material 26 is thermally coupled with the conductive surface 22 of the thermoelectric module 14. To provide the conductive material for the thermal coupling, an upper thermal transfer block 30 is located on top of the graphene sheet material 26 and a lower heat transfer block 32 is located below the graphene sheet material 26 and in contact with the conductive surface of the thermoelectric module 14. The upper and lower thermal transfer blocks 32 act to sandwich the graphene sheet material 26 there between for purposes of forming a thermally conductive coupling. Optionally, a thermal interface material, such as thermal grease, silver filled gels, filled waxes, silicones, or pads or the like may be used between the thermal transfer blocks and the graphene sheet material to provide a void free contact for efficient heat transfer. Also, in additional examples, the thermoelectric module could be increased in size and therefore increase the area of direct contact with the graphene sheet material, so as to optionally eliminate one or each of the thermal transfer blocks.

The seat system shown in FIG.1 includes a seat surface 12 (at a seat cushion or seat back or bench) defined by an outer cover 34, such as a fabric or non-fabric seat upholstery material. The outer cover 34 of the seat is supported by a resiliently flexible support member 36, such as a foam member, that acts as a support for the seat occupant. In a thermoelectrically cooled seat system, the graphene sheet material 26 is usually many degrees cooler than the ambient environment. This is because the graphene sheet material must be much cooler than the seat occupant to provide a noticeable temperature differential and therefore, the thermal potential, to effectively remove heat from the seat occupant. The seat cover 34 and the seat occupant's clothing provide a thermal resistance that must be overcome by a temperature differential between the occupant and the composite structure extending from the thermoelectric module. In addition, other components of the seat system, such as the foam member 36, can indirectly add some heat into the system, where the thermoelectric module can also remove at least some the heat in these additional components.

Figure 3:
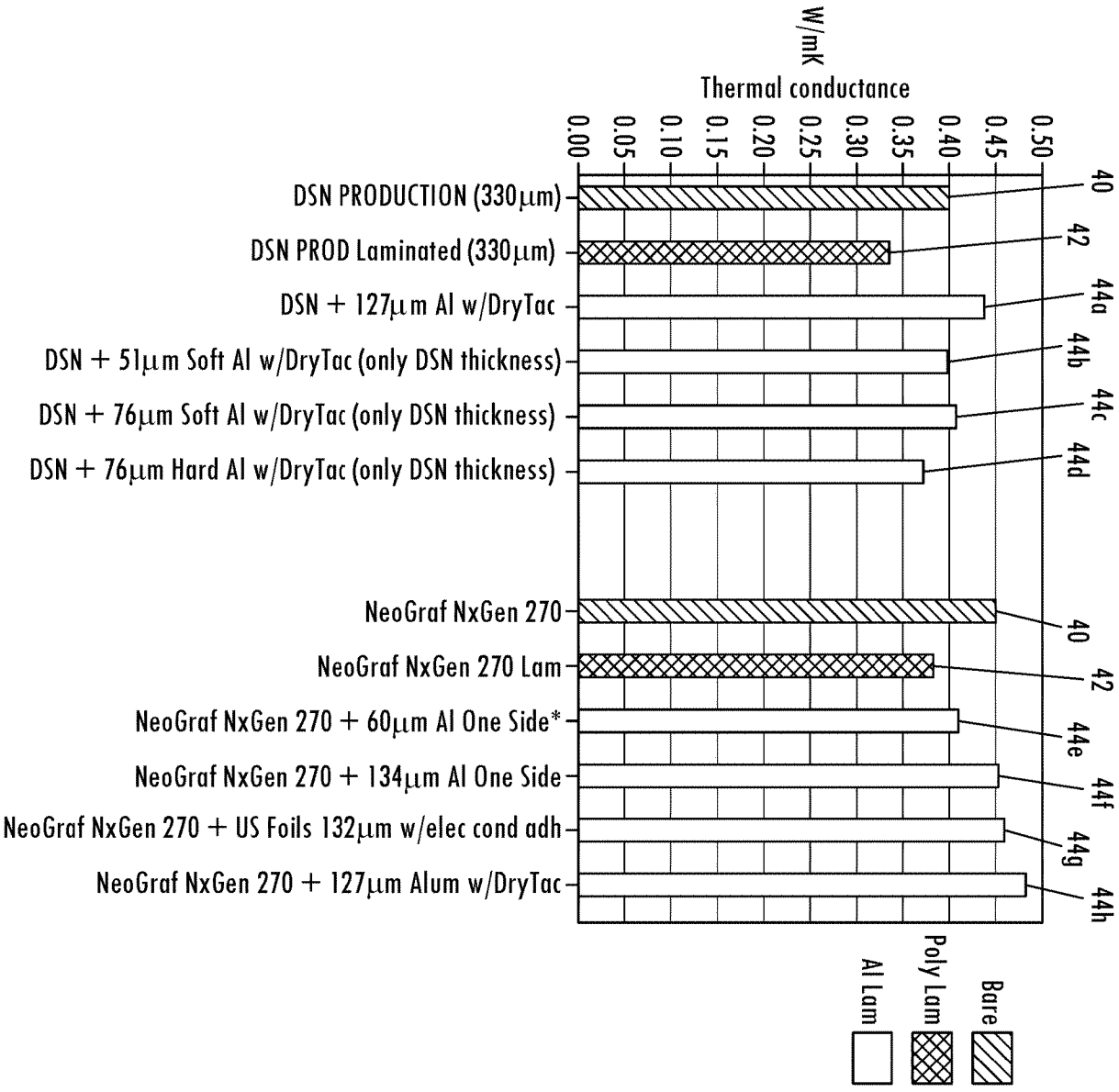
FIG. 3 is a bar chart showing the thermal conductance of various conductive structures.

As shown in FIG. 3, the thermal conductance of two types of bare graphene sheet 40 is provided. These bare graphene sheets 40, though somewhat flexible, when formed into thin sheets or strips have brittle characteristics due to its platelet-like morphology and relatively weak Van der Waals bonds of the carbon to carbon layers. To strengthen the bare graphene material, a thin plastic film can be bonded to the graphene sheets/strips to provide a polymer laminated graphene sheet 42 that enhance the graphene's robustness in bending and flexing. Plastic films, however, have a low thermal conductivity (e.g., around 0.12 to 0.30 W/mK), such that the polymer laminated graphene sheets 42 shown in FIG. 3 have a relatively low thermal conductivity, as driving heat through the Z-direct is impeded by the plastic film.

Figure 4:
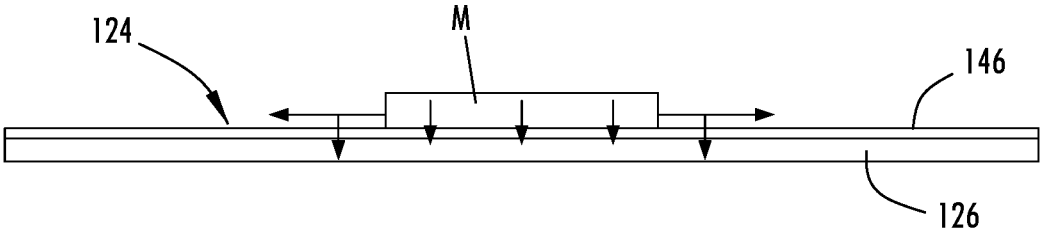
FIG. 4 is a side elevation view of a composite structure having a high thermal conductivity isotropic cladding interfacing with a source of thermal energy, showing directional heat transfer.

To enhance the heat transfer of the composite structure 124 used to transfers heat between the thermoelectric module and the seat occupant, a high thermal conductivity isotropic cladding 146 (FIG. 4) is disposed on the graphene sheet material 126 at least partially outside of the portion directly interfacing with the thermoelectric module, such as near the thermoelectric module or near a seat surface. The isotropic cladding conductively transfers heat in a direction generally aligned with the thickness of the graphene sheet material, such as in the Z direction when referencing the plan of the sheet in the X-Y plane or in a direction orthogonal to a planar extent of the graphene sheet material, with a higher thermal conductively than the graphene sheet material in this direction. With the highly conductive isotropic cladding 146 overlaying the graphene sheet material 126, the combination of the two materials have a lower overall thermal conductivity than the graphene sheet material alone. However, when heat enters the composite structure 124 conductively through the highly conductive isotropic cladding 146, it conductively moves heat very well in the X, Y, and Z direction. Heat flows into the high conductivity cladding 146 in the Z direction and also flows readily in the X-Y plane, providing an increased surface area for conducting heat into the graphene structure, improving overall heat transfer. In that the highly conductive isotropic cladding 146 covers an area on the graphene sheet material 126 that is greater than the smaller heat input point at the mass M, the heat is spread over a much larger area, providing a much greater thermal contact area that allows a greater quantity of heat to transfer into the graphene sheet material 126 for transport in the X-Y plane. In contrast, when a heat source is in contact with the X-Y plane of the graphene material, the heat movement is impeded due to the poor Z direction thermal conductivity of the graphene material. For example, as shown in FIG. 3, the thermal conductance of different implementations of graphene sheet material **44*a*-44*h*** that have isotropic cladding deployed as an aluminum layer. Moreover, in some examples, the isotropic cladding can also improve the robustness and strength of the flexibility of the graphene sheet material, so as to optionally omit polymer film, at least partially, on the graphene sheet and thereby omit the associated insulating effect provided by such polymers.

As used in this disclosure, the term "cladding" generally refers to one or more pieces of material that are used as a cover or overlay on a surface of the graphene sheet material, as described in more detail herein. The structure of the piece or pieces of cladding may be a sheet, a foil, a strip, a slat, a block, or other conceivable material structures. Such cladding may be fixed or loosely disposed relative to the underlying graphene sheet material and may include intermediate thin films or adhesives disposed in a layer or discrete locations between the cladding and graphene sheet material.

Figure 5:
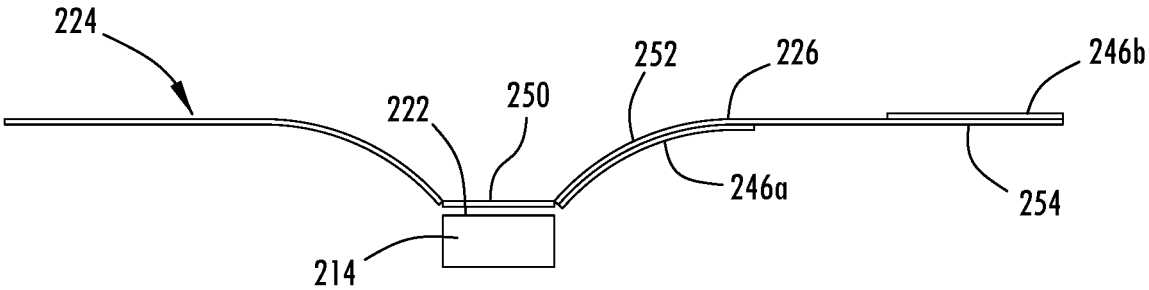
FIG. 5 is a side elevation view of another example of a composite structure having high thermal conductivity isotropic cladding.

Referring to FIG. 5, an example of a composite structure 224 is shown that conductively transfers heat to and from a thermoelectric module 214 so to provide heating or cooling to a person's body, such as for implementation in a seat system and associated heating and cooling devices and systems for conductively heating or cooling a seat occupant. As shown in FIG. 5, the composite structure 224 includes a graphene sheet material 226 that has an interfacing portion 250 that is thermally coupled with and overlaying the conductive surface 222 of the thermoelectric module 214. For example, the interfacing portion 250 may be thermally coupled to the thermoelectric module 214 in the manner illustrated in FIG. 1 with one or more thermal transfer blocks. A high thermal conductivity isotropic cladding is disposed at least partially over an outlying portion of the graphene sheet material 226 outside of the interfacing portion 250 to conductively transfer heat in a direction orthogonal to a planar extent of the graphene sheet material 250 with a higher thermal conductively than the graphene sheet material in this direction.

In the example shown in FIG. 5, two pieces of isotropic cladding **246*a*, 246*b* are disposed on the graphene sheet material 226. It is contemplated that additional implementations of heating and cooling devices may deploy one or both or additional pieces of isotropic cladding, as described herein. The lower piece of isotropic cladding 246***a* is disposed at a lower surface of the graphene sheet material 226 and extends outward from the interfacing portion 250 to cover an intermediate portion 252 of the graphene sheet material 226 that is adjacent to the interfacing portion 250. In other words, the lower piece of isotropic cladding 246*a* is disposed at an inner surface of the graphene sheet material 226 that faces the thermoelectric module 214. The lower piece of isotropic cladding 246*a* effectively expands the surface area of isotropic material that interfaces with the graphene sheet material 226, as the interfacing surface 222 of the thermoelectric module 214 is typically isotropic in nature. As such, the lower piece of isotropic cladding 246*a* provides a relatively high thermally conductive pathway that transmits heat over a wide area, allowing more heat to reach the highly conductive X-Y plane of the graphene for transmission of the heat over a distance spanned by the graphene sheet material. By arranging the isotropic cladding 246*a* near the heat transfer surface of the thermoelectric module 14, it increases heat transfer from the graphene to the thermoelectric system, resulting in more heat being pumped out of the system. Again, since the system is fully reversible, the seat occupant can also be heated with the thermoelectric system pumping heat into the system and the isotropic cladding providing similar benefits.

As also shown in FIG. 5, an upper piece of isotropic cladding 246*b* is disposed at an upper surface of the graphene sheet material 226 and extends outward from the intermediate portion 252 to cover a distal portion 254 of the graphene sheet material 226. In other words, the upper piece of isotropic cladding 246*b* is disposed at an outer surface of the graphene sheet material 226 opposite a side facing the thermoelectric module 214. The upper piece of isotropic cladding 246*b* is strategically located on the graphene sheet material 226 to promote high heat transfer to or from an object in the location where the cladding is provided. For instance, in a seating application, the isotropic cladding 246*b* is disposed on the graphene sheet material in the seating area or generally in the area or areas nearest the seating surface. As shown in FIG. 5, such as if incorporated into the seat of FIG. 1, the distal portion 254 is provided with the isotropic cladding 246*b* to as to be nearest or against the underside of the seat cover 34 that provides the seat surface 12 at an outer side thereof. As such, the upper piece of isotropic cladding 246*b* also provides a relatively high thermally conductive pathway that transmits heat more efficiently to the highly conductive X-Y plane of the graphene for transmission to the thermoelectric module.

Conversely, as further shown in FIG. 5, the isotropic cladding is omitted where desired to generally retard heat transfer to or from the graphene where desired. Specifically, the lower piece of isotropic cladding 246*a* terminates before extending onto the distal portion 254 of the graphene sheet material 226, so as to omit any isotropic cladding at the lower surface of the graphene sheet material at the distal portion thereof. Similarly, the upper piece of isotropic cladding 246*b* terminates before extending onto the intermediate portion 252 of the graphene sheet material 226, so as to omit any isotropic cladding at the upper surface of the graphene sheet material 226 at the intermediate portion thereof. In omitting the isotropic cladding on these portions, the system has less transfer heat loss by avoiding enhanced conductive heat transfer in these omitted areas, such as when the environment surrounding the graphene in these areas is warmer than the graphene during seat occupant cooling.

Figure 6:
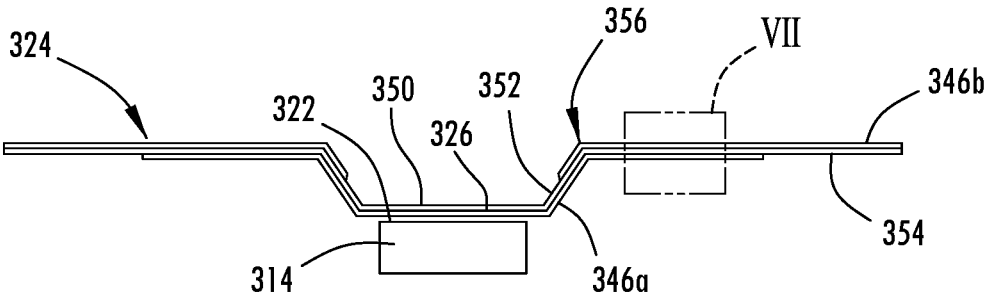
FIG. 6 is a side elevation view of a further example of a composite structure having high thermal conductivity isotropic cladding.
Figure 7:
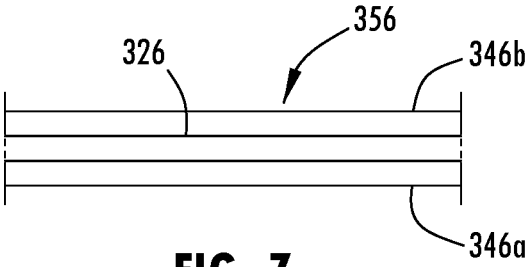
FIG. 7 is an enlarged partial view of the composite structure shown in FIG. 6, taken at section VII.

As shown in FIGS. 6 and 7, an additional example of a composite structure 324 is provided with overlapping areas 356 of the upper and lower pieces of isotropic cladding 346*a*, 346*b* on opposing sides of the graphene sheet material 326. The overlapping areas 356 partially occupy the intermediate portions 352 and the distal portions 354. The resulting construction provides a lesser area omitting isotropic cladding at the intermediate and distal portions 352, 354.

Figure 8:
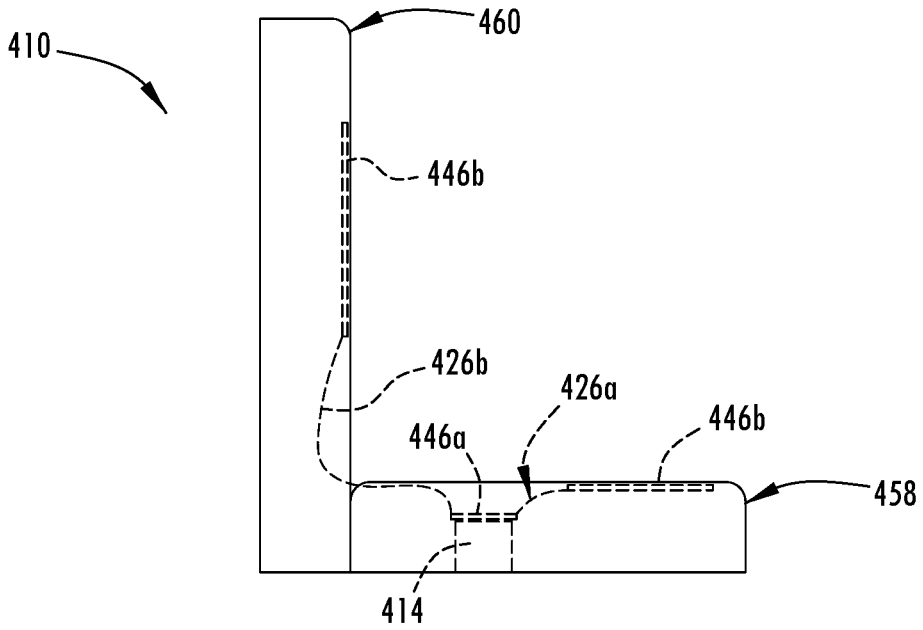
FIG. 8 is a side elevation view of a heating and cooling device in a seat with a seat cushion and a seat back.

A further implementation is shown in FIG. 8 where the heating and cooling device 410 is incorporated into a seat system with a seat cushion 458 and a seat base 460. As shown, a seat section 426*a* of the graphene sheet material extends from the thermoelectric module to the seat cushion 458 and a back section 426*b* of the graphene sheet material extends from the thermoelectric module to the seat back 460. In this example, the upper pieces of isotropic cladding are disposed at the distal portions of the respective seat section 426*a* and back section 426*b* of the graphene sheet material. Accordingly, the thermoelectric module 414 operates to transfer heat from both the occupant support areas on the seat cushion 458 and the seat back 460. In additional examples, it is contemplated that a single seat may include one or more thermoelectric modules to provide the desired heat transfer conditions.

Figure 9:
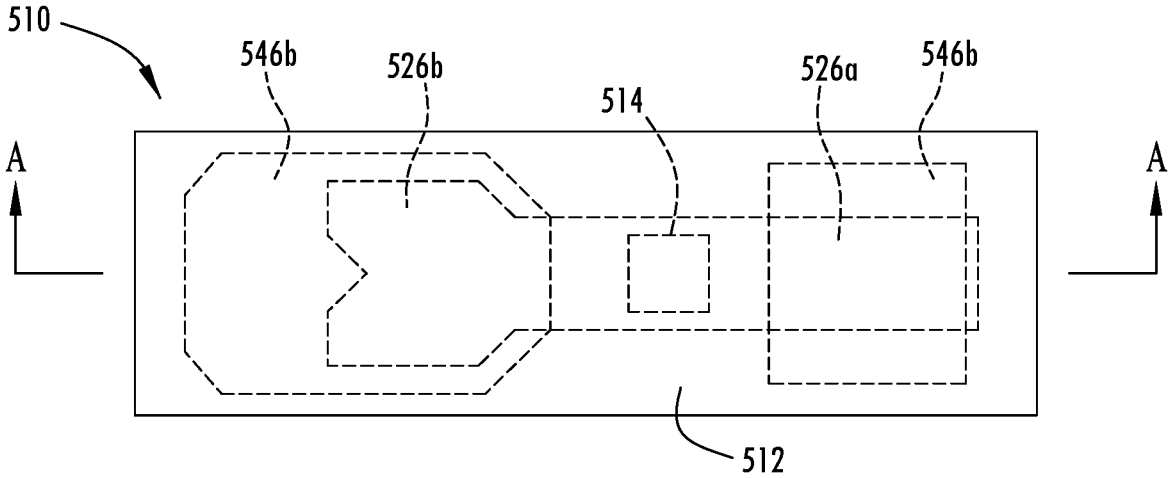
FIG. 9 is a top view of a heating and cooling device in a seat with two separate sections of high thermal conductivity isotropic cladding.
Figure 9A:
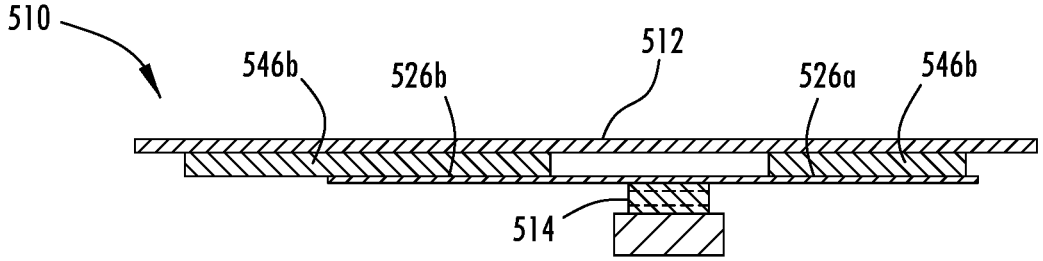
FIG. 9A is a cross-sectional view of the heating and cooling device shown in FIG. 9.

Similarly, as shown in FIGS. 9 and 10, the heating and cooling device 510 is incorporated into a seat system with two occupant support areas, such as for two separate occupants on a single seat, such as for use on an ATV seat, motorcycle seat, or a personal water craft seat. As shown, a front seat section 526*a* of the graphene sheet material extends from the thermoelectric module 514 to the front area of the seat. Also, a back seat section 526*b* of the graphene sheet material extends from the thermoelectric module 514 to the back area of the seat. In this example, the upper pieces 546*b* of high thermal conductivity isotropic cladding are disposed at the distal portions of the front and back seat sections 526*a*, 526*b* of the graphene sheet material. Accordingly, the thermoelectric module 514 operates to transfer heat from both the occupant support areas on the seat surface 512 of the seat.

The high thermal conductivity isotropic cladding described herein may be a metal foil, such as aluminum foil, which has a thermal conductivity of approximately 225 W/mk. Thus, in some examples, the thermal conductivity of the isotropic cladding is considered to be "high" in relation to the thermal conductivity of the surrounding materials, such that in some examples the high thermal conductivity is greater than 200 W/mK. Other alloys or materials with an isotropically high thermal conductivity could be substituted for aluminum, providing they are flexible. In applications where flexibility is not a concern, isotropic high conductivity materials that are rigid, could be used. In the seating applications, the graphene sheet material and the isotropic cladding may both be flexible. For example, the graphene sheet material and the isotropic cladding may each have a Young's modulus of less than 100 GPa.

In additional implementations, a thin plastic sheet made of polyethylene or any other suitable substrate may be bonded or otherwise adhered to the graphene sheet material, such as in desired areas in order to exhibit greater strength and resistance to ongoing stress and strain due to persons getting in and out of seats or the like. For example, the surface areas of the graphene sheet material where isotropic cladding is omitted may beneficially include a thin plastic film or sheet to insulate the outer surface where Z direction conductive heat transfer is undesirable.

Moreover, in some select areas where it may be desirable to provide plastic sheet material and Z direction conductive heat transfer is still desirable, some implementations may include the use of a thermally conductive plastic sheeted material with an inclusion of intermittent bits of highly thermally conductive components, such as carbon or graphene nanoparticles, graphene nanotubes, or graphene nanoplatelets in order to improve the thermal conductivity of the thermally conductive plastic sheeted material.

In additional examples, the composite structure may include many different thermally conductive heat transfer materials, such as woven materials, thermally conductive polymers, carbon based conductive materials such as carbon fiber fabric or graphite fabrics, and including the recently available graphene nanoplatelets sheets.

For purposes of this disclosure, the term "coupled" (in all of its forms, couple, coupling, coupled, etc.) generally means the joining of two components directly or indirectly to one another. Such joining may be stationary in nature or movable in nature; may be achieved with the two components and any additional intermediate members being integrally formed as a single unitary body with one another or with the two components; and may be permanent in nature or may be removable or releasable in nature, unless otherwise stated.

Also for purposes of this disclosure, the articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional implementations that also incorporate the recited features. Furthermore, the terms "first," "second," and the like, as used herein do not denote any order, quantity, or importance, but rather are used to denote element from another.

Numbers, percentages, ratios, or other values stated herein are intended to include that value, and also other values that are "about" or "approximately" the stated value, as would be appreciated by one of ordinary skill in the art encompassed by implementations of the present disclosure. A stated value should therefore be interpreted broadly enough to encompass values that are at least close enough to the stated value to perform a desired function or achieve a desired result. For example, the terms "approximately," "about," and "substantially" may refer to an amount that is within less than 5% of, within less than 1% of, within less than 0.1% of, and within less than 0.01% of a stated amount.

Further, it should be understood that any directions or reference frames in the preceding description are merely relative directions or movements. For example, the terms "upper," "lower," "right," "left," "rear," "front," "vertical," "horizontal," "inner," "outer" and derivatives thereof shall relate to the orientation shown in FIG. 1. However, it is to be understood that various alternative orientations may be provided, except where expressly specified to the contrary. It is also to be understood that the specific devices and processes illustrated in the attached drawings, and described in this specification are simply exemplary embodiments of the inventive concepts defined in the appended claims. Hence, specific dimensions and other physical characteristics relating to the embodiments disclosed herein are not to be considered as limiting, unless the claims expressly state otherwise.

Changes and modifications in the specifically described embodiments may be carried out without departing from the principles of the present invention, which is intended to be limited only by the scope of the appended claims as interpreted according to the principles of patent law. The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

The invention claimed is:

1. A heating and cooling device for conductively heating or cooling a body, the heating and cooling device comprising:

a thermoelectric module configured to move heat to or from a conductive surface thereof in response to low voltage power applied to the thermoelectric module; and a composite structure configured to conductively transfer heat between the thermoelectric module and the body, the composite structure comprising:

a graphene sheet material having an interfacing portion thermally coupled with and overlaying the conductive surface of the thermoelectric module; and a high thermal conductivity isotropic cladding abuts and is at least partially overlaying an outlying portion of the graphene sheet material outside of the interfacing portion to conductively transfer heat in a direction orthogonal to a planar extent of the graphene sheet material that is abutting the high thermal conductivity isotropic cladding with a higher thermal conductivity than the graphene sheet material in said direction.

2. The heating and cooling device of claim 1, wherein the isotropic cladding comprises a metal foil.

3. The heating and cooling device of claim 1, wherein the graphene sheet material and the isotropic cladding are both flexible.

4. The heating and cooling device of claim 1, wherein the graphene sheet material has a first directional thermal conductivity taken along the planar extent of the graphene sheet material that is from 375 W/mK to 5000 W/mK.

5. The heating and cooling device of claim 4, wherein the graphene sheet material has a second directional thermal conductivity taken orthogonal to the planar extent of the graphene sheet material that is less than 100 W/mK.

6. The heating and cooling device of claim 1, wherein thermal conductivity of the isotropic cladding is greater than 200 W/mK.

7. The heating and cooling device of claim 1, wherein the isotropic cladding is disposed between the conductive surface of the thermoelectric module and the interfacing portion of the graphene sheet material.

8. The heating and cooling device of claim 7, wherein the isotropic cladding is disposed at an inner surface of the graphene sheet material facing the thermoelectric module.

9. The heating and cooling device of claim 1, wherein the isotropic cladding is disposed at an outer surface of the graphene sheet material opposite a side facing the thermoelectric module.

10. A thermally conductive composite structure configured to conductively transfer heat between a thermoelectric module and a body, the thermally conductive composite structure comprising:

a flexible thermally conductive sheet comprising a graphene material disposed in a planar extent of the flexible thermally conductive sheet, the flexible thermally conductive sheet having an interfacing portion configured to interface with the thermoelectric module or the body, wherein thermal conductivity of the graphene material along the planar extent is from 375 W/mK to 5000 W/mK and orthogonal to the planar extent is less than 100 W/mK; and an isotropic cladding abuts and is at least partially overlaying an outlying portion of the flexible thermally conductive sheet that is outside of the interfacing portion, wherein thermal conductivity of the isotropic cladding is greater than 200 W/mK.

11. The thermally conductive composite structure of claim 10, wherein the isotropic cladding comprises an aluminum foil.

12. The thermally conductive composite structure of claim 10, wherein the flexible thermally conductive sheet and the isotropic cladding each have a Young's modulus of less than 100 GPa.

13. The thermally conductive composite structure of claim 10, wherein the isotropic cladding is disposed between a conductive surface of the thermoelectric module and the flexible thermally conductive sheet.

14. The thermally conductive composite structure of claim 10, wherein the isotropic cladding is disposed at an outer surface of the flexible thermally conductive sheet at a location configured to thermally couple with the body.

15. A heating and cooling device for conductively heating or cooling a body, the heating and cooling device comprising:

a thermoelectric module configured to move heat to or from a thermally conductive surface thereof in response to low voltage power applied to the thermoelectric module; and a flexible composite structure configured to conductively transfer heat between the thermoelectric module and the body, the flexible composite structure comprising:

a graphene sheet material having a first portion thermally coupled with and overlaying the thermally conductive surface of the thermoelectric module; and a high thermal conductivity isotropic cladding abuts and is overlaying the first portion of the graphene sheet material and at least partially overlaying a second portion of the graphene sheet material outside of the first portion;

wherein the isotropic cladding is configured to conductively transfer heat between the thermoelectric module and the first and second portions of the graphene sheet material in a direction orthogonal to a planar extent of the graphene sheet material that is abutting the high thermal conductivity isotropic cladding with a higher thermal conductivity than the graphene sheet material in said direction.

16. The heating and cooling device of claim 15, wherein the isotropic cladding comprises a metal foil.

17. The heating and cooling device of claim 16, wherein thermal conductivity of the graphene sheet material along the planar extent is greater than 300 W/mK.

18. The heating and cooling device of claim 17, wherein thermal conductivity of the graphene sheet material in the direction orthogonal to the planar extent of the graphene sheet material is less than 100 W/mK.

19. The heating and cooling device of claim 18, wherein thermal conductivity of the isotropic cladding is greater than 200 W/mK.

* * * * *